US006812936B2

(12) United States Patent
Hoppenbrouwers

(10) Patent No.: US 6,812,936 B2
(45) Date of Patent: Nov. 2, 2004

(54) METHOD OF AND UNIT FOR DISPLAYING AN IMAGE IN SUB-FIELDS

(75) Inventor: Jurgen Jean Louis Hoppenbrouwers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 311 days.

(21) Appl. No.: 10/082,005

(22) Filed: Feb. 21, 2002

(65) Prior Publication Data

US 2002/0158820 A1 Oct. 31, 2002

(30) Foreign Application Priority Data

Feb. 23, 2001 (EP) ..... 01200667

(51) Int. Cl.[7] ..... G09G 5/10

(52) U.S. Cl. ..... 345/691; 345/690; 345/693; 345/63; 345/72; 345/88; 345/89

(58) Field of Search ..... 345/60, 63, 87, 345/89, 589, 591, 690, 691, 693

(56) References Cited

U.S. PATENT DOCUMENTS

| | | | | |
|---|---|---|---|---|
| 5,841,413 A | | 11/1998 | Zhu et al. | 345/63 |
| 6,335,735 B1 | * | 1/2002 | Denda et al. | 345/589 |
| 6,639,605 B2 | * | 10/2003 | Van Dalfsen et al. | 345/690 |
| 6,646,625 B1 | * | 11/2003 | Shigeta et al. | 345/63 |
| 6,674,446 B2 | * | 1/2004 | Van Dalfsen et al. | 345/691 |

FOREIGN PATENT DOCUMENTS

| | | | |
|---|---|---|---|
| EP | 0833299 A1 | 4/1998 | G09G/3/28 |
| EP | 0884717 | 12/1998 | G09G/3/28 |
| EP | 0884717 A1 | 12/1998 | G09G/3/28 |

OTHER PUBLICATIONS

"True–Motion Estimation with 3–D Recursive Search block Matching" by g. DE Haan, IEEE Transactions on Circuits and Systems for Video Technology, vol. 3, No. 5, Oct. 1993, pp. 368–388.

"IC For Motion–Compensated DE–Interlacing, Noise Reduction, and Picture–Rate Conversion" by G. de Haan, IEEE Transactions on Consumer Electronics, vol. 45, Aug. 1999, pp. 617–624.

* cited by examiner

*Primary Examiner*—Kent Chang
*Assistant Examiner*—Tommy Sheng
(74) *Attorney, Agent, or Firm*—Edward W. Goodman

(57) ABSTRACT

An image processing unit (300) for processing an image that is to be displayed in a plurality of sub-fields on a plasma display panel (406), has a storage (304) for storing the set of combinations of sub-fields that are available as intensity levels, and a selector (310) for selecting, from the storage, a particular combination for a pixel to be displayed. The difference regarding sub-fields between a first one of the combinations representing a first available illumination level, and a second one of the combinations representing the next higher illumination level, has been limited, the limiting including control such that only a limited number of the sub-fields that are switched on in the first one of the combinations, are not switched on in the second one of the combinations.

9 Claims, 2 Drawing Sheets

METHOD OF AND UNIT FOR DISPLAYING AN IMAGE IN SUB-FIELDS

BACKGROUND OF THE INVENTION

1. Field of the Invention

The invention relates to a method of displaying an image on a display device in a plurality of periods called sub-fields, where the display device is capable of generating, in each of the sub-fields, a respective illumination level, the method comprising the steps of:

generating a set of combinations of sub-fields, each element of the set representing a respective available illumination level, selecting, for pixels of the image, particular combinations of sub-fields from the set in conformity with the intensity value of the respective pixels, and sending, for each of these pixels, a representation of the selected combination of sub-fields to the display device in order to display the particular pixel.

The invention also relates to an image processing unit for processing an image to be displayed on a display device in a plurality of periods called sub-fields, wherein the display device is capable of generating in each of the sub-fields a respective illumination level, the image display unit comprising:

storage means for storing a set of combinations of sub-fields, each element of the set corresponding to a respective available illumination level, selection means for selecting from the set a particular combination of sub-fields in conformity with the intensity value of a particular pixel of the image, and sending means for sending a representation of the selected combination of sub-fields to the display device in order to display the particular pixel.

The invention also relates to an image display apparatus comprising such an image processing unit.

2. Description of the Related Art

The European Patent Application Number EP 884 717 A1, corresponding to U.S. Pat. No. 5,841,413, describes a plasma display panel driven in a plurality of sub-fields. A plasma display panel is made up of a number of cells that can be switched on and switched off. A cell corresponds to a pixel (picture element) of the image that is to be displayed on the panel. Three phases can be distinguished in the operation of the plasma display panel. The first phase is the erasure phase in which the memories of all cells of the panel are erased. The second phase is the addressing phase in which the cells of the panel that are to be switched on are conditioned by setting appropriate voltages on their electrodes. The third phase is the sustain phase in which sustain pulses are applied to the cells which cause the addressed cells to emit light for the duration of the sustain phase. The plasma display panel emits light during this sustain phase. The three phases together are called a sub-field period, or simply a sub-field. A single image, or frame, is displayed on the panel in a number of successive sub-field periods. A cell may be switched on for one or more of the sub-field periods. The light emitted by a cell in the sub-field periods in which it was switched on is integrated in the eye of the viewer who perceives a corresponding intensity for that cell. In a particular sub-field period, the sustain phase is maintained for a particular time, resulting in a particular illumination level of the activated cells. Typically, different sub-fields have different durations of their sustain phase. A sub-field is given a coefficient of weight to express its contribution to the light emitted by the panel during the whole frame period. An example is a plasma display panel with 6 sub-fields having coefficients of weight of 1, 2, 4, 8, 16 and 32, respectively. Selecting the appropriate sub-fields in which a cell is switched on, enables 64 different intensity levels to be realized in displaying an image on this panel. The plasma display panel is then driven by using binary code words of 6 bits each, such a code word indicating the intensity level of a pixel in binary form.

In driving a plasma display panel, the frame period, i.e., the period between two successive images, is separated into a number of sub-field periods. During each of these sub-field periods, a cell may or may not be switched on and integration over the sub-field periods results in a perceived intensity level of the pixel corresponding to this cell. Instead of displaying a pixel at a given moment in time, on a plasma display panel, the pixel seems to be displayed as a series of sub-pixels shifted in time with respect to each other. This may cause artifacts if a series of images contains a moving object. The eyes of the viewer track the moving object, while the elements of the object emit light at various different moments. These temporal differences between parts of the object are translated into spatial differences by the tracking eye, resulting in artifacts, like false contours. Another artifact is motion blur. Motion blur occurs if the intensity level of the pixels of a moving object is generated in a large number of sub-fields. It is then clearly noticeable that the light of a pixel has been emitted at the various different moments.

The motion of an object needs to be taken into account when displaying the object in a number of sub-fields. For each next sub-field, the object must be moved a little. Motion compensation techniques are used to calculate a corrected position for the sub-pixels in the sub-fields. In some circumstances, the motion compensation is not fully reliable and may produce erroneous results, for example, in an area of the image containing little detail. The erroneous results lead to motion compensation where this should not be done. This also gives motion artifacts that are very visible.

An artifact is most noticeable if two neighboring pixels have a small difference in intensity level while, for one of the pixels, the sub-field with the largest coefficient of weight is switched on and, for the other pixel, this sub-field is switched off. In case of the example of the binary code above, the code word for one pixel has the most significant bit on and the code word for the other pixel has the most significant bit off. Any error in the calculated position of a sub-field, i.e., any motion artifact involving these pixels, will then cause a relatively large artifact in the displayed image. An example of the occurrence of a motion artifact in the plasma display panel with 6 sub-fields is the transition from intensity level '31' to intensity level '32'. The level '31' has the 5 lower sub-fields switched on and the highest sub-field switched off. For the level '32', the 5 lower sub-fields are switched off and the highest sub-field is switched on. This causes a very visible artifact if there is motion involved. The device described in EP 884 717 A1 tries to mitigate motion artifacts by restricting the code words that are used. This known device employs more sub-fields than necessary for realizing the required set of intensity values. The resultant set of code words for expressing the intensity value is redundant, i.e., for a given intensity value, more than one code word is available. From this redundant set, there is formed a subset for which those code words are selected that give the fewest motion artifacts for expressing a difference between the intensity values. This subset is created by searching the original set and determining what the effect on the artifacts may be for a difference between a given code word and each of the other code words.

SUMMARY OF THE INVENTION

It is an object of the invention to provide a method, as described in the preamble, which offers an improved reduction of artifacts. This object is achieved according to the invention by a method that is characterized in that the set is generated while limiting a difference regarding sub-fields between a first one of the combinations representing a first available illumination level and a second one of the combinations representing the next higher illumination level in the set, the limiting including control such that only a limited number of the sub-fields that are switched on in the first one of the combinations are not switched on in the second one of the combinations. For creating a set with a comparatively large number of different available illumination levels, it is desirable that the combination for the next higher level may have a number of sub-fields switched off that are switched on for the given level. This provides an amount of freedom to create the comparatively large number of different levels. Limiting the number of sub-fields that are switched off for the next higher level ensures that the set of combinations of sub-fields, according to the invention, will suffer less from dynamic false contours. As described above, an area with a small spatial graduation, i.e., an area where neighboring pixels have a very small mutual difference in intensity level, may suffer heavily from motion artifacts, like false contours. Because, in such an area, the invention effectively controls the mutual differences in sub-fields between neighboring pixels, the chance of motion artifacts is reduced. There are fewer sub-fields that change value between pixels and, therefore, fewer timing errors leading to the artifacts are likely to occur.

An embodiment of the method according to the invention, wherein the limiting includes control such that only two of the sub-fields that are switched on in the first one of the combinations are not switched on in the second one of the combinations, provides a good balance between the number of available combinations of sub-fields and the reduction of dynamic false contours in the case of motion.

A further embodiment of the method according to the invention, wherein the limiting includes control such that only one of the sub-fields that are switched on in the first one of the combinations is not switched on in the second one of the combinations, provides a good balance between the number of available combinations of sub-fields and the reduction of dynamic false contours in the case of motion at comparatively high speeds.

Another embodiment of the method according to the invention, wherein a first sub-field is switched on in the first one of the combinations and not switched on in the second one of the combinations, wherein a second sub-field is not switched on in the first one of the combinations and switched on in the second one of the combinations, and wherein the first sub-field and the second sub-field are temporally adjacent, motion artifacts as described above are reduced further. Any difference in time between a pixel of a given intensity level and a pixel of the next higher level will be small, thus further reducing the chance of a motion artifact.

A further embodiment yet of the method according to the invention notes that it is advantageous to generate the available intensity levels in such a way that they are uniform in the perception of the viewer. The reduced number of levels, when compared with a binary distribution, is thus used efficiently in view of the perceived quality of the image.

In another embodiment of the method according to the invention, the perceptual scale is substantially defined according to the function $L=x^Y$, in which L is the perceived luminance, x is the number of the available illumination level in the set, and $_Y$ is a constant of a value between 2 and 3. This distribution of available intensity levels corresponds to the inverse of the gamma filtering that is applied to video signals produced by a camera. Therefore, this embodiment does not require the separate step of inverse gamma filtering as applied in the known method.

In a further embodiment of the method according to the invention, a complementary set of combinations of sub-fields is generated to increase the number of available illumination levels, which complementary set is not limited regarding the changes between particular ones of the combinations, the original set and the complementary set together forming an overall set of available illumination levels, wherein it is examined whether there is motion between the image and a preceding image, and wherein, if motion is found to be present, the particular combination of sub-fields is selected from the original set, and if no motion is found to be present, the particular combination of sub-fields is selected from the overall set. This version allows that the combination of sub-fields for a pixel of a still image is selected from an overall set containing a large number of available illumination levels and that the combination of sub-fields for a pixel from an image containing a moving object is selected from a set with a limited number of available illumination levels suffering less from motion artifacts. In this way, a still image which will not suffer from motion artifacts since there is no motion, is displayed with a large number of intensity levels whereas only an image with motion is displayed with the reduced number intensity levels.

In yet another embodiment of the method according to the invention, a complementary set of combinations of sub-fields is generated to increase the number of available illumination levels, which complementary set is not limited regarding the changes between particular ones of the combinations, the original set and the complementary set together forming an overall set of available illumination levels, wherein it is determined whether a particular object or area in the image is in motion between the image and a preceding image, and wherein for pixels of the moving object the particular combination of sub-fields is selected from the original set and for pixels of the image that do not belong to the moving object the particular combination of sub-fields is selected from the overall set. According to this version only the moving object itself is displayed with the reduced number of intensity levels while the non-moving parts of the image are displayed with the higher number of intensity levels.

It is a further object of the invention to provide an image processing unit as described in the preamble which offers an improved reduction of artifacts. This object is achieved according to the invention by an image processing unit that is characterized in that, in the set, a difference regarding sub-fields between a first one of the combinations representing a first available illumination level, and a second one of the combinations representing the next higher illumination level in the set, has been limited, the limiting including control such that only a limited number of the sub-fields that are switched on in the first one of the combinations are not switched on in the second one of the combinations.

BRIEF DESCRIPTION OF THE DRAWINGS

The invention and its attendant advantages will be further elucidated with the aid of exemplary versions and embodiments and the accompanying schematic drawings, wherein.

Corresponding features in the various Figures are denoted by the same reference symbols.

DESCRIPTION OF THE PREFERRED EMBODIMENTS

Figure 1:
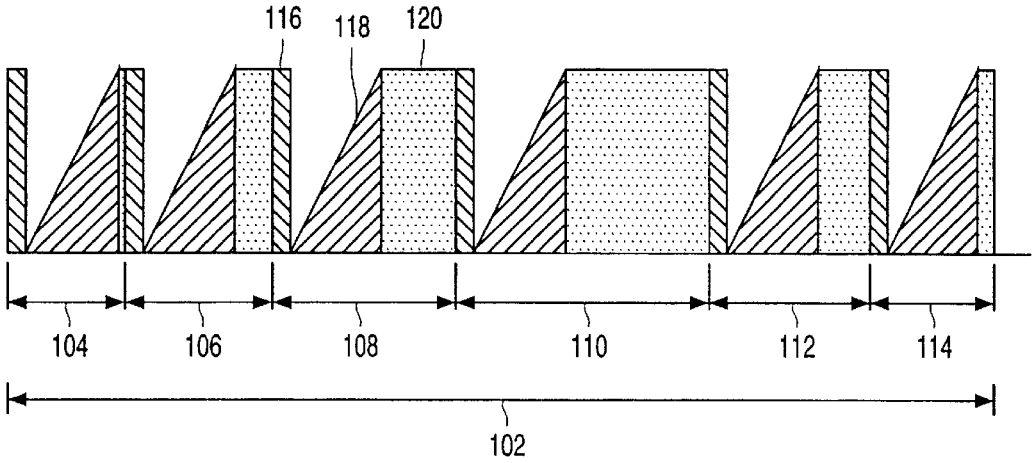
FIG. 1 schematically shows a field period with 6 sub-fields.

FIG. 1 schematically shows a field period with 6 sub-fields. The field period 102, also called the frame period, is the period in which a single image or frame is displayed on the display panel. In this example, the field period 102 consists of 6 sub-fields denoted by references 104–114. In a sub-field, a cell of the display panel may be switched on in order to produce an amount of light. Each sub-field starts with an erasure phase in which the memories of all cells are erased. The next phase in the sub-field is the addressing phase in which the cells that are to be switched on for emitting light in this particular sub-field are conditioned. In a subsequent third phase of the sub-field, which is called the sustain phase, sustain pulses are applied to the cells. This causes the cells that have been addressed to emit light during the sustain phase. The organization of these phases is shown in FIG. 1 where time runs from left to right. For example, sub-field 108 has an erasure phase 116, an addressing phase 118 and a sustain phase 120. It is to be noted that in some panels, the sub-field ends with the erasure phase rather than starting with it. However, this is of no significance to the invention which can be applied in either case.

The perceived intensity of a pixel of a displayed image is determined by controlling during which of the sub-fields the cell corresponding to the pixel is switched on. The light emitted during the various sub-fields in which a cell is switched on is integrated in the eyes of the viewer, thus resulting in a given intensity of the corresponding pixel. A sub-field has a coefficient of weight indicating its relative contribution to the emitted light. An example is a plasma display panel with 6 sub-fields having coefficients of weight of 1, 2, 4, 8, 16 and 32, respectively. By selecting the appropriate combination of sub-fields in which a cell is switched on, 64 different intensity levels can be realized in displaying an image on this panel. The plasma display panel is then driven by using binary code words of 6 bits each, such a code word indicating the intensity level of a pixel in binary form.

A particular realization of the invention uses a plasma display panel that is driven in 8 sub-fields. Table I below shows the set of available intensity levels for displaying an image in this embodiment. It shows the weights that have been chosen for each of the sub-fields. Furthermore, the order of the sub-fields in the field period is shown: the left sub-field in the table is the first one in the field period, the neighboring sub-field is the second, and so on, ending with the extreme right sub-field which is the last one in the field period. Table I shows 21 available illumination levels for realizing the desired intensity level. For each level there are indicated: its sequential number, its relative intensity level, and in what sub-fields the panel must be ignited to realize the particular level.

TABLE I

Set Of Available Intensity Levels According To The Invention

| Level Number | Level Intensity | Sub-field weights 4 | 10 | 30 | 54 | 91 | 42 | 18 | 6 |
|---|---|---|---|---|---|---|---|---|---|
| 0 | 0 | | | | | | | | |
| 1 | 4 | x | | | | | | | |
| 2 | 10 | x | | | | | | | x |
| 3 | 16 | | x | | | | | | x |
| 4 | 20 | x | x | | | | | | x |
| 5 | 32 | x | x | | | | | x | |
| 6 | 38 | x | x | | | | | x | x |
| 7 | 58 | x | | x | | | | x | x |
| 8 | 64 | | x | x | | | | x | x |
| 9 | 68 | x | x | x | | | | x | x |
| 10 | 92 | x | x | x | | | x | | x |
| 11 | 104 | x | x | x | | | x | x | |
| 12 | 110 | x | x | x | | | x | x | x |
| 13 | 134 | x | x | | x | | x | x | x |
| 14 | 154 | x | | x | x | | x | x | x |
| 15 | 160 | | x | x | x | | x | x | x |
| 16 | 164 | x | x | x | x | | x | x | x |
| 17 | 213 | x | x | x | x | x | | x | x |
| 18 | 237 | x | x | x | x | x | x | | x |
| 19 | 249 | x | x | x | x | x | x | x | |
| 20 | 255 | x | x | x | x | x | x | x | x |

The main characteristic of the set of available intensity levels of Table I is that between a certain intensity level and the next higher level, at most, one sub-field is switched off. For example, to generate level 10, all sub-fields that are used for level 9 are now also used, with the exception of the 7th sub-field. Another example is level 11 where all sub-fields that are used for level 10 are again used. By limiting the number of sub-fields that are switched off for the next higher level, dynamic false contours are suppressed since fewer errors can occur in images with motion.

In addition to limiting the number of sub-fields that are switched off, the set of available levels of Table I has a further characteristic that further improves the reduction of motion artifacts. This further characteristic is optional and functions in addition to the above limitation. This further characteristic is to limit differences between two neighboring intensity levels to adjacent sub-fields. Hence, if a difference between two neighboring levels involves two sub-fields, these sub-fields are adjacent. Adjacent sub-fields are ignited successively in time, that is, with a comparatively small difference in time. This makes that any timing errors between these sub-fields will be small and will not easily lead to motion artifacts. An example is the difference between level 9 and level 10: level 9 has the 6th sub-field off and the 7th sub-field on, while level 10 has the 6th sub-field on and the 7th sub-field off. As described above, adjacent sub-fields in the table denote sub-fields that directly succeed each other in the order of sub-fields in the field period.

Table II below shows an alternative set of available intensity levels:

TABLE II

Alternative Set Of Available Intensity Levels According To The Invention

| Level Number | Level Intensity | Sub-field weights 4 | 11 | 27 | 57 | 87 | 42 | 19 | 8 |
|---|---|---|---|---|---|---|---|---|---|
| 0 | 0 | | | | | | | | |
| 1 | 4 | x | | | | | | | |

TABLE II-continued

| Level Number | Level Intensity | Alternative Set Of Available Intensity Levels According To The Invention — Sub-field weights 4 | 11 | 27 | 57 | 87 | 42 | 19 | 8 |
|---|---|---|---|---|---|---|---|---|---|
| 2 | 12 | x | | | | | | | x |
| 3 | 19 | | x | | | | | | x |
| 4 | 23 | x | x | | | | | | x |
| 5 | 34 | x | x | | | | | x | |
| 6 | 42 | x | x | | | | | x | x |
| 7 | 54 | | | x | | | | x | x |
| 8 | 58 | x | | x | | | | x | x |
| 9 | 65 | | x | x | | | | x | x |
| 10 | 69 | x | x | x | | | | x | x |
| 11 | 84 | x | x | x | | | x | | |
| 12 | 92 | x | x | x | | | x | | x |
| 13 | 103 | x | x | x | | | x | x | |
| 14 | 111 | x | x | x | | | x | x | x |
| 15 | 130 | x | | | x | | x | x | x |
| 16 | 141 | x | x | | x | | x | x | x |
| 17 | 157 | x | | x | x | | x | x | x |
| 18 | 168 | x | x | x | x | | x | x | x |
| 19 | 194 | x | x | x | x | x | | | x |
| 20 | 213 | x | x | x | x | x | | x | x |
| 21 | 236 | x | x | x | x | x | x | | x |
| 22 | 255 | x | x | x | x | x | x | x | x |

In the set of Table II, the limitation regarding the sub-fields that are switched off for the next higher level is somewhat relaxed. The main characteristic of the set of available intensity levels of Table II is that between a certain intensity level and the next higher intensity level, at most, two sub-fields are switched off. For example, to generate level 15, all sub-fields that are used for level 14 are now also used, with the exception of the 2nd and 3rd sub-field. Also in this Table II, if multiple sub-fields are different between two neighboring intensity levels, these multiple sub-fields are positioned adjacent each other. Relaxing the limitation provides a greater freedom in defining the intensity levels. This greater freedom may be used to generate a larger number of different levels. The example of Table II has 2 more levels than the example of Table I. Furthermore, the greater freedom may be used to make a better distribution of the intensity level.

In an embodiment of the method and unit according to the invention, the set of Table I is extended with a number of additional levels that can be generated with the chosen sub-field weights. The additional levels are not limited regarding their differences with other levels and provide for an increase of the available intensity levels that can be used for displaying an image. Thus, the extended set contains the original set of Table I with the sub-field limitation and the additional set without such limitation. Now, in this embodiment, the images to be displayed are analyzed and it is determined whether the images involve the display of motion or whether they involve still images. A simple motion detector can be used for this purpose, for example, as described by I. Kawahara and K. Sekimoto in 'Dynamic Gray-Scale Control to Reduce Motion Picture Disturbance of High-resolution PDP', SID 1999, page 166. If it is determined that there is no motion, the available levels of the extended set are used to display the desired intensity in the image. However, if the presence of motion is detected, the available levels of the original set are used thus reducing the dynamic false contours that may appear because of the motion. As an alternative to the motion detector, a more complex motion estimator can be used. Such a motion estimator is generally known from the art and provides details as to what objects in the image are moving and it can even indicate at what speeds they are moving. In this respect see, for example, 'True motion estimation with 3-D recursive search block-matching' by G. de Haan, IEEE Transactions on Circuits and Systems for Video Technology, Vol. 3, No. 5, October 1993, pp. 368–388, and 'IC for motion-compensated de-interlacing, noise reduction and picture rate conversion' by G. de Haan, IEEE Transactions on Consumer Electronics, Vol. 45, August 1999, pp. 617–624. For displaying an image in the embodiment using a motion estimator, a difference is made between pixels belonging to a moving object and pixel belonging to the background that is not moving. For the display of pixels of the moving object, only intensity levels of the original set are used, while intensity levels of the whole extended set are used for the pixels at rest. In this way, parts that do not move are displayed with a comparatively large number of intensity levels, thus providing a high quality display. Only the moving parts are displayed with the reduced number of intensity levels, sacrificing a number of intensity levels in exchange for a reduction of dynamic false contours.

An embodiment with an extended set of intensity levels can also use the Table II. An extended set may have different kinds of combinations regarding the limitation on the changes of sub-fields between neighboring intensity levels. In a further embodiment, the extended set may have a first subset with combinations of sub-fields where at most one sub-field is allowed to be switched off for the next higher level (as in Table I), a second subset where at most two sub-fields are allowed to be switched off for the next higher level (as in Table II) and a third sub-set without any limitation. Note that the first sub-set is a sub-set of the second sub-set and that both are a sub-set of the third sub-set. What combinations are available for a given pixel, i.e., from which sub-set combinations may be selected, is then dependent on the speed at which this pixel moves. If the pixel is at rest, the third sub-set may be used, i.e., all levels are available. If the pixel moves at a comparatively low speed, the second sub-set is used, and if the pixel moves at a comparatively high speed, the first sub-set is used. In this way, an improved balance is achieved between the reduction of available intensity levels and the reduction of dynamic false contours.

Figure 2:
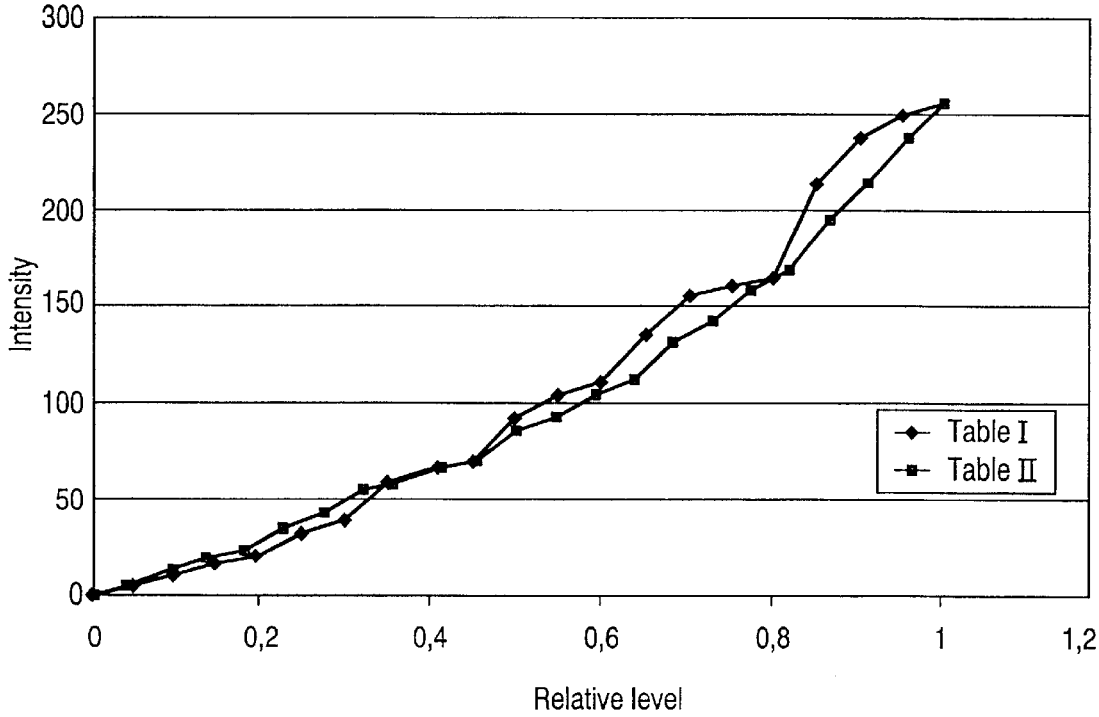
FIG. 2 graphically shows the intensity levels of Table I and Table II.

FIG. 2 graphically shows the intensity levels of Table I and Table II. The number of intensity levels in these tables is smaller than what could be realized with 8 sub-fields with a binary distribution of the coefficients of weight. In order to use the available number of levels as efficiently as possible, in particular to display the gray scales of an image as well as possible, the levels have been selected uniformly on a perceptual scale. This means that the perceived luminance difference between any two intensity levels is roughly the same. The different levels are then close to each other for low intensity levels, i.e., dark areas of an image, and further apart for high intensity levels, i.e., the bright areas of an image. This is advantageous regarding the perception of the human viewer who can see smaller luminance differences in low intensity areas than in high intensity areas.

An example of a perceptual scale is the one that has been adopted by the CIE (Commission Internationale de l'

Éclairage) as standard function. This function L* (L-star) is defined as follows:

$$L^* = \begin{cases} 903.3\dfrac{L}{L_n}, & \dfrac{L}{L_n} \le 0.008856 \\ 116\left(\dfrac{L}{L_n}\right)^{\frac{1}{3}} - 16, & 0.008856 < \dfrac{L}{L_n} \end{cases} \quad (1)$$

wherein:

L is the luminance, $L_n$ is the luminance of the white reference, and

L* is the perceived luminance, also called lightness.

A particular advantageous distribution of the intensity levels is to position the levels on a so-called gamma correction curve. Video signals produced by a camera are passed through a gamma filter. Therefore, incoming video signals that are to be displayed need to be gamma corrected using an inverse filter. Now, a CRT (cathode ray tube) intrinsically has such filtering, because the relation between luminance output and video signal voltage input is approximately a gamma correction curve. A plasma display panel, however, has a linear relation between the luminance output and the video input. Therefore, a system for displaying an image on a plasma display panel needs a gamma correction filter (see, for example, block 102 in FIG. 1A of EP 884 717 A1). Now, by positioning the selected levels on a gamma correction curve, the gamma correction is applied by directly using the defined levels and the explicit step of gamma correction can be avoided. The gamma correction curve is given by the following formula:

$$L = x^{\gamma} \quad (2)$$

wherein:

L is the output luminance, x is the number of the intensity level, and $\gamma$ is a constant of a value between 2 and 3.

The value of $\gamma$ is typically chosen to be 2.3, but may be different for different applications or for different geographical regions.

In FIG. 2, the horizontal axis indicates the available levels and the vertical axis the intensity. The marks indicate the intensity of the particular level. The graph approximates the gamma correction curve. Another choice of the coefficients of weight for one or more sub-fields will result in a different graph.

The above embodiment has 21 intensity levels available to display a pixel if Table I is applied, and 23 intensity levels if Table II is applied. To simulate the display of an image with a higher number of levels, a technique called error diffusion can be applied. Error diffusion is a serial process that proceeds as follows: at each pixel the desired level is rounded to the nearest quantization level, which is the output. The error is computed by subtracting the quantized value from the desired value. This error is 'diffused' by adding fractions of it to the desired values of nearby unquantized pixels. The precise pattern of how the error is distributed determines the resultant patterns in the image. Error diffusion is a well-known technique and is, for instance, described in the article by R. W. Floyd and L. Steinberg, called 'Adaptive algorithm for spatial grey scale', SID Int. Sym. Dig. Tech. Papers, pp. 36–37, 1975. Techniques other than error diffusion may be used to improve the perceived number of gray levels.

The above embodiments include a set of 21 or 23 different intensity levels for displaying an image. The invention allows the use of sets with another number of intensity levels. This can be realized, for example, by defining other coefficients of weight and other combinations of sub-fields. Levels other than those shown in Table I and Table II can then be generated. Alternatively, a panel be used that can be operated in more than 8 sub-fields. The following table shows an example for the available levels for such a panel according to the invention.

TABLE III

Set Of Available Intensity Levels For A Panel With 10 Sub-Fields

| Level Number | Level Intensity | Sub-field weights 1 | 4 | 12 | 32 | 62 | 2 | 6 | 18 | 40 | 78 |
|---|---|---|---|---|---|---|---|---|---|---|---|
| 0 | 0 | | | | | | | | | | |
| 1 | 1 | x | | | | | | | | | |
| 2 | 3 | x | | | | | x | | | | |
| 3 | 6 | | x | | | | x | | | | |
| 4 | 7 | x | x | | | | x | | | | |
| 5 | 11 | x | x | | | | | x | | | |
| 6 | 13 | x | x | | | | x | x | | | |
| 7 | 21 | x | | x | | | x | x | | | |
| 8 | 24 | | x | x | | | x | x | | | |
| 9 | 25 | x | x | x | | | x | x | | | |
| 10 | 37 | x | x | x | | | x | | x | | |
| 11 | 41 | x | x | x | | | | x | x | | |
| 12 | 43 | x | x | x | | | x | x | x | | |
| 13 | 63 | x | x | | x | | x | x | x | | |
| 14 | 70 | | | x | x | | x | x | x | | |
| 15 | 75 | x | x | x | x | | x | x | x | | |
| 16 | 97 | x | x | x | x | | x | x | | x | |
| 17 | 107 | x | x | x | x | | | | x | x | |
| 18 | 115 | x | x | x | x | | x | x | x | x | |
| 19 | 145 | x | x | x | | x | x | x | x | x | |
| 20 | 161 | x | | | x | x | x | x | x | x | |
| 21 | 172 | | | x | x | x | x | x | x | x | |
| 22 | 177 | x | x | x | x | x | x | x | x | x | |
| 23 | 215 | x | x | x | x | x | x | x | x | | x |
| 24 | 231 | x | x | x | x | x | x | | | x | x |
| 25 | 247 | x | x | x | x | x | | | x | x | x |
| 26 | 255 | x | x | x | x | x | x | x | x | x | x |

Figure 3:
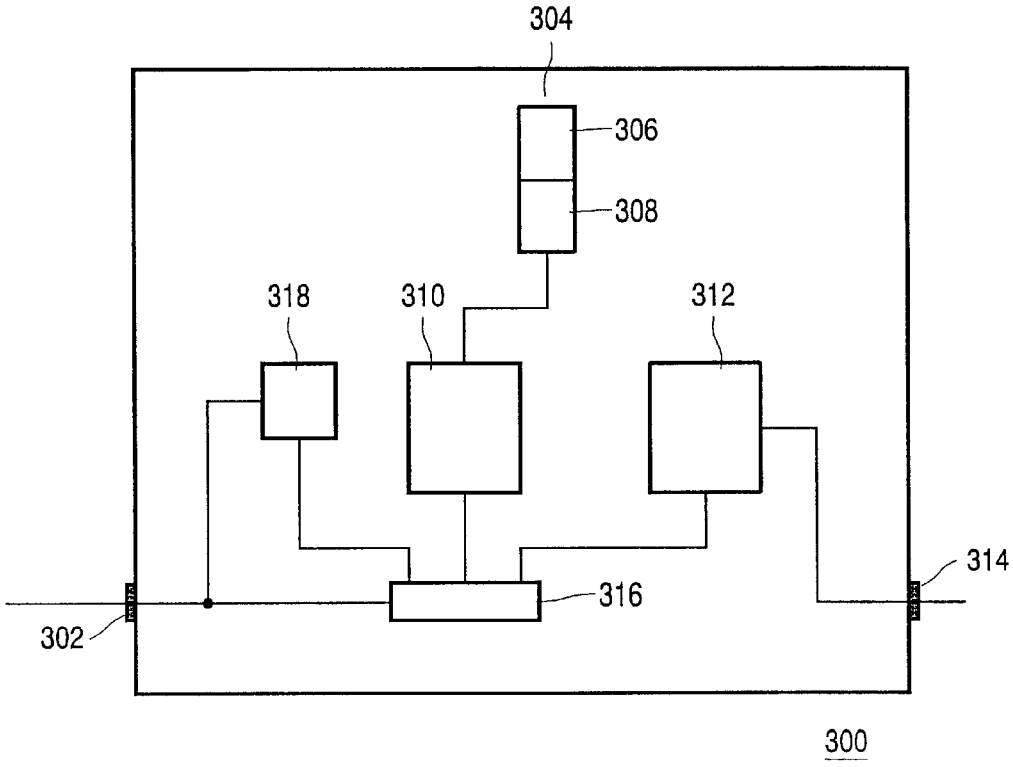
FIG. 3 schematically shows the most important elements of an image.

FIG. 3 schematically shows the most important elements of an image processing unit according to the invention. The image processing unit 300 has an input 302 for receiving the pixels of an image to be processed for display. The image processing unit 300 has storage means 304 for storing the combinations of sub-fields that are available for displaying the image. The storage means 304 may have different parts for storing combinations of sub-fields with different characteristics. In the example of FIG. 2, the storage means 304 has a first part 306 for storing the combinations of sub-fields that are to be used in the case of motion and a second part 308 for storing additional combinations. These combinations with different characteristics have been described above. The image processing unit 300 also has selection means 310 that selects, for a given pixel, the appropriate combination of sub-fields from the storage means 304 in order to display that pixel as much as possible in conformity with its desired intensity. The image processing unit 300 also has sending means 312 for sending the selected combination of sub-fields via an output 314 to a display device. In order to control the operation of the various elements, the image processing unit 300 has a control unit 316. The image processing unit 300 may be implemented with a processor and a memory according to a known computer architecture. The various units are then implemented as software modules for performing the required function.

The image processing unit 300 optionally has motion means 318 to detect motion in the images to be displayed. The selection means 310 then selects the combination of sub-fields for a particular pixel in dependence on whether that pixel is in motion or even in dependence on the speed of motion of the pixel. The motion means 318 may be a simple motion detector that compares two subsequent images and decides that motion exists if the two images differ sufficiently. Alternatively, the motion means 318 may be a motion estimator that is able to detect moving objects and their speed between two successive images. In the latter case, only the pixels of a moving object are displayed with the reduced number of intensity levels as described above.

Figure 4:
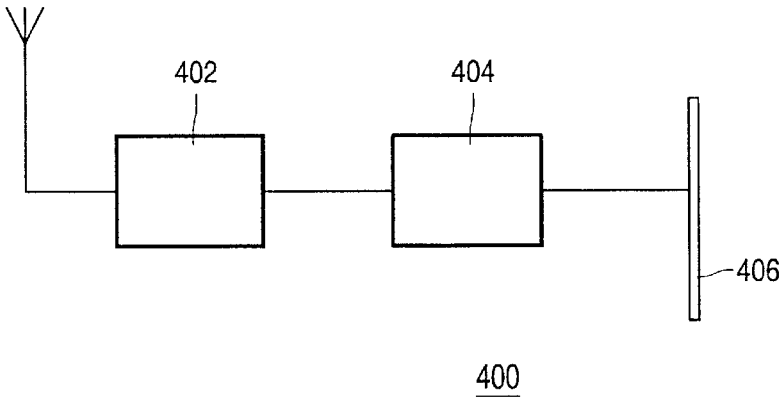
FIG. 4 shows the most important elements of an image display apparatus.

FIG. 4 shows the most important elements of an image display apparatus according to the invention. The image display apparatus 400 has a receiving means 402 for receiving a signal representing the image to be displayed. This signal may be a broadcast signal received via an antenna or cable but may also be a signal from a storage device, like a VCR (Video Cassette Recorder). The image display apparatus can then be implemented as a traditional television receiver. The signal may also be generated by a computer, like a Personal Computer, and the image display apparatus may then be a monitor for that computer. The image display apparatus 400 also has an image processing unit 404 for processing the image and a display device 406 for displaying the processed image. The display device 406 is of a type that is driven in sub-fields. The image processing unit is implemented as described in connection with FIG. 3.

The invention has been described for an image composed of pixels, each having a given intensity level. The invention can be applied to black and white images and to color images. In a color image, a pixel has a separate intensity level for each color that is used. The selection of the combinations of sub-fields according to the invention may then be carried out for each of the colors independently.

It should be noted that the above-mentioned embodiments illustrate rather than limit the invention and that those skilled in the art will be able to design many alternative embodiments without departing from the scope of the appended claims. In the claims, any reference signs placed between parentheses shall not be construed as limiting the claim. The word 'comprising' does not exclude the presence of elements or steps other than those listed in a claim. The word "a" or "an" preceding an element does not exclude the presence of a plurality of such elements. The invention can be implemented by means of hardware comprising several distinct elements and by means of a suitably programmed computer. In the apparatus claims enumerating several means, several of these means can be embodied by one and the same item of hardware.

What is claimed is:

1. A method of displaying an image on a display device in a plurality of periods called sub-fields, in which the display device is capable of generating, in each of the sub-fields, a respective illumination level, the method comprising the steps of:

generating a set of combinations of sub-fields, each element of the set representing a respective available illumination level;

selecting, for pixels of the image, particular combinations of sub-fields from the set in conformity with the intensity value of the respective pixels; and sending, for each of these pixels, a representation of the selected combination of sub-fields to the display device in order to display the particular pixel, characterized in that the set is generated while limiting a difference regarding sub-fields between a first one of the combinations representing a first available illumination level, and a second one of the combinations representing the next higher illumination level in the set, the limiting including control such that only a limited number of the sub-fields that are switched on in the first one of the combinations are not switched on in the second one of the combinations, wherein the available illumination levels are substantially uniformly spaced on a perceptual scale, and wherein the perceptual scale is substantially defined according to the function $L=x^Y$, in which L is the perceived luminance, x is the number of the available illumination level in the set, and $_Y$ is a constant of a value between 2 and 3.

2. The method as claimed in claim 1, wherein the limiting includes control such that only two of the sub-fields that are switched on in the first one of the combinations are not switched on in the second one of the combinations.

3. The method as claimed in claim 1, wherein the limiting includes control such that only one of the sub-fields that are switched on in the first one of the combinations is not switched on in the second one of the combinations.

4. The method as claimed in claim 1, wherein a first sub-field is switched on in the first one of the combinations and not switched on in the second one of the combinations, wherein a second sub-field is not switched on in the first one of the combinations and switched on in the second one of the combinations, and wherein the first sub-field and the second sub-field are temporally adjacent.

5. The method as claimed in claim 1, wherein a complementary set of combinations of sub-fields is generated to increase the number of available illumination levels, which complementary set is not limited regarding the changes between particular ones of the combinations, the original set and the complementary set together forming an overall set of available illumination levels, wherein it is examined whether there is motion between the image and a preceding image, and wherein, if motion is found to be present, the particular combination of sub-fields is selected from the original set, and if no motion is found to be present, the particular combination of sub-fields is selected from the overall set.

6. The method as claimed in claim 1, wherein a complementary set of combinations of sub-fields is generated to increase the number of available illumination levels, which complementary set is not limited regarding the changes between particular ones of the combinations, the original set and the complementary set together forming an overall set of available illumination levels, wherein it is determined whether a particular object or area in the image is in motion between the image and a preceding image, and wherein for pixels of the moving object the particular combination of sub-fields is selected from the original set and for pixels of the image that do not belong to the moving object the particular combination of sub-fields is selected from the overall set.

7. An image processing unit for processing an image to be displayed on a display device in a plurality of periods called sub-fields, wherein the display device is capable of generating in each of the sub-fields a respective illumination level, the image display unit comprising:

storage means for storing a set of combinations of sub-fields, each element of the set corresponding to a respective available illumination level;

selection means for selecting, from the set, a particular combination of sub-fields in conformity with the intensity value of a particular pixel of the image; and sending means for sending a representation of the selected combination of sub-fields to the display device in order to display the particular pixel, characterized in that in the set, a difference regarding sub-fields between a first one of the combinations representing a first available illumination level and a second one of the combinations representing the next higher illumination level in the set has been limited, the limiting including control such that only a limited number of the sub-fields that are switched on in the first one of the combinations are not switched on in the second one of the combinations, wherein the available illumination levels of the set are substantially uniformly spaced on a perceptual scale; and wherein the perceptual scale is substantially defined according to the function $L=x^Y$, in which L is the perceived luminance, x is the number of the available illumination level in the set, and Y is a constant of a value between 2 and 3.

8. The image processing unit as claimed in claim 7, wherein in the set of available illumination levels a first sub-field is switched on in the first one of the combinations and not switched on in the second one of the combinations, wherein a second sub-field is not switched on in the first one of the combinations and switched on in the second one of the combinations, and wherein the first sub-field and the second sub-field are temporally adjacent.

9. An image display apparatus for displaying an image, comprising:

receiving means for receiving a signal representing the image;

an image processing unit as claimed in claim 7; and a display device for displaying the image.

* * * * *